US007387459B2

(12) United States Patent
Liu et al.

(10) Patent No.: US 7,387,459 B2
(45) Date of Patent: Jun. 17, 2008

(54) PORTABLE PRINTER AND METHOD

(75) Inventors: Chin-Chuan Liu, Taipei (TW); Hung-Kun Liao, Keelung (TW)

(73) Assignee: Paxar Americas, Inc., Miamisburg, OH (US)

( * ) Notice: Subject to any disclaimer, the term of this patent is extended or adjusted under 35 U.S.C. 154(b) by 0 days.

(21) Appl. No.: 11/333,845

(22) Filed: Jan. 18, 2006

(65) Prior Publication Data

US 2007/0166092 A1 Jul. 19, 2007

(51) Int. Cl.
*B41J 11/26* (2006.01)
*B44C 7/00* (2006.01)

(52) U.S. Cl. ..... 400/611; 101/288; 400/88

(58) Field of Classification Search ..... 400/611, 400/88, 613, 621; 101/288, 291–293, 328, 101/333; 156/384
See application file for complete search history.

(56) References Cited

U.S. PATENT DOCUMENTS 5,049,228 A 9/1991 Sato
5,209,374 A * 5/1993 Seidl-Lichthardt ..... 221/73
5,427,460 A * 6/1995 Kajiya ..... 400/118.1
5,486,259 A 1/1996 Goodwin et al.
5,525,184 A 6/1996 Luff et al.
5,892,531 A 4/1999 Mistyurik et al.
6,241,407 B1 6/2001 Huggins et al.
6,261,013 B1 7/2001 Bryer et al.
6,491,459 B2 * 12/2002 Hosomi ..... 400/613
6,530,705 B1 * 3/2003 Petteruti et al. ..... 400/611
7,083,344 B2 * 8/2006 Miyasaka et al. ..... 400/613

FOREIGN PATENT DOCUMENTS

JP 11-314624 * 11/1999

OTHER PUBLICATIONS

Seiko Instruments, Inc.; LTP V Series Thermal Printer Mechanism Technical Reference; U00060114300; dated Jul. 2001.

* cited by examiner

*Primary Examiner*—Daniel J. Colilla
*Assistant Examiner*—M. Ferguson-Samreth
(74) *Attorney, Agent, or Firm*—Joseph J. Grass

(57) ABSTRACT

There is disclosed a portable printer operable in either a strip mode or a peel mode. In the peel mode, a pressure roll cooperates with a carrier web and the platen roll to strip labels from the web. A battery-powered electric motor advances a printable web through the printer. In order to reduce drag on the motor in the strip mode, the pressure roll is held in out of pressure contact with the platen roll.

6 Claims, 17 Drawing Sheets

PORTABLE PRINTER AND METHOD

BACKGROUND OF THE INVENTION

1. Field of the Invention

This invention relates to printers that print on printable webs including label webs and to printing methods.

2. Brief Description of the Prior Art

The following U.S. Patents are made of record: U.S. Pat. Nos. 5,049,228; 5,486,259; 5,525,184; 5,892,531; 6,241,407; and 6,261,013. Also made of record is Seiko Instruments, Inc., LTP V Series Thermal Printer Mechanism Technical Reference U00060114300 dated July 2001.

SUMMARY OF THE INVENTION

A specific embodiment of the invention provides an improved printer operable in either a strip mode wherein a printable strip is printed and dispensed or in a peel mode wherein labels on a carrier web are printed and are peeled or dispensed from a carrier web, wherein the printable strip can comprise, for example, a composite web with labels releasably adhered to a carrier web or a web of receipt material. The printer has a print head such as a thermal print head, a driven platen roll cooperable with the print head, a delaminator disposed downstream of the print head, and a pressure roll disposed downstream of the delaminator. The pressure roll is mounted to be out of cooperation with the platen roll in the strip mode to reduce the drag on the electric motor that advances the printable strip in the strip mode. However, in the peel mode the pressure roll is in pressure cooperation with the carrier web and the platen roll. The pressure roll is selectively positionable for operation in either the strip mode or the peel mode. A specific embodiment of a method includes selectively positioning the pressure roll out of pressure cooperation with the platen roll in the strip mode or in pressure cooperation with the carrier web and the platen roll in the peel mode. A specific embodiment includes a holder for the pressure roll, wherein a tear bar is on or a part of the holder.

BRIEF DESCRIPTION OF THE DIAGRAMMATIC DRAWINGS

DETAILED DESCRIPTION OF THE PREFERRED EMBODIMENTS

Figure 1:
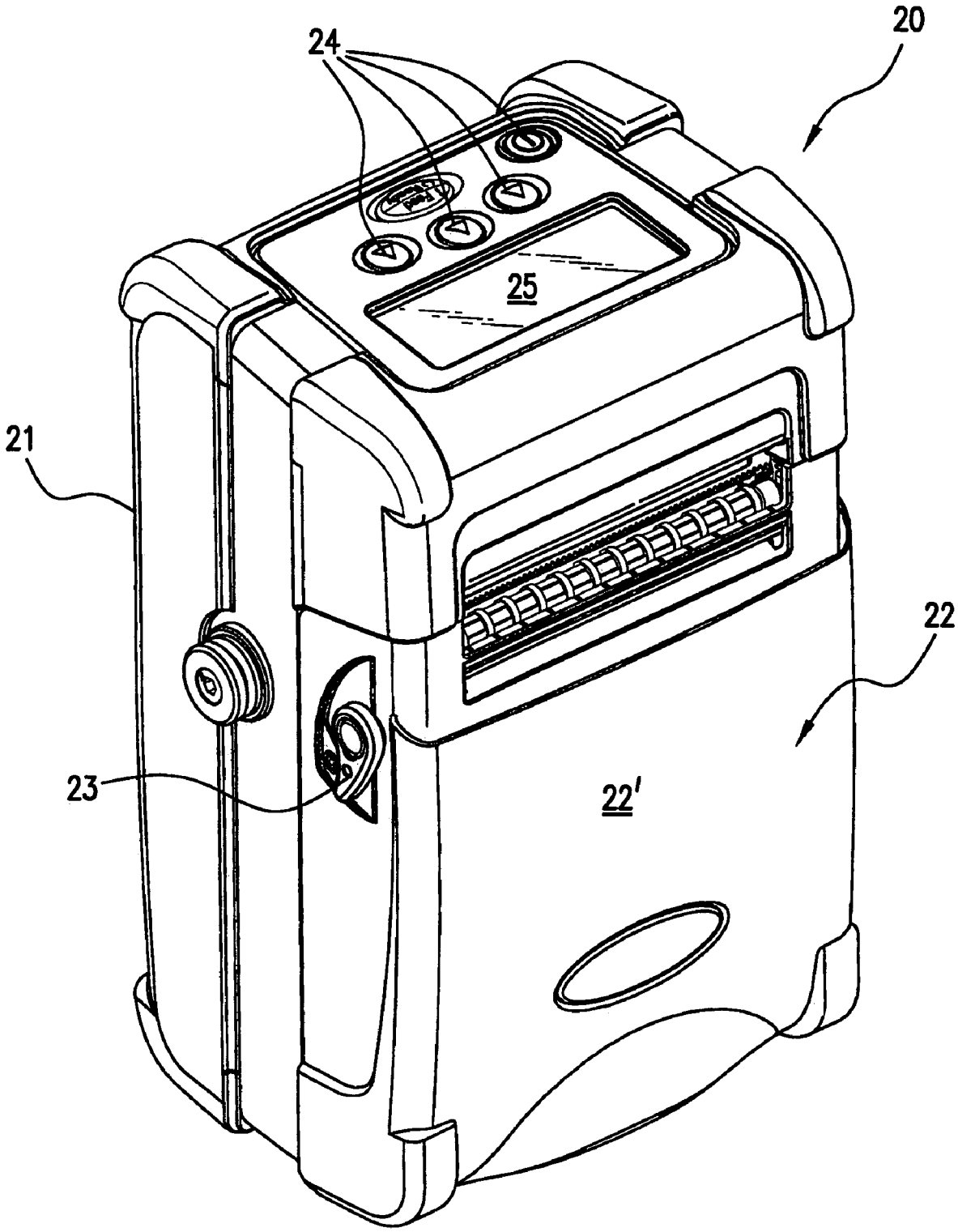
FIG. 1 is a perspective view of a printer in accordance with the invention.
Figure 2:
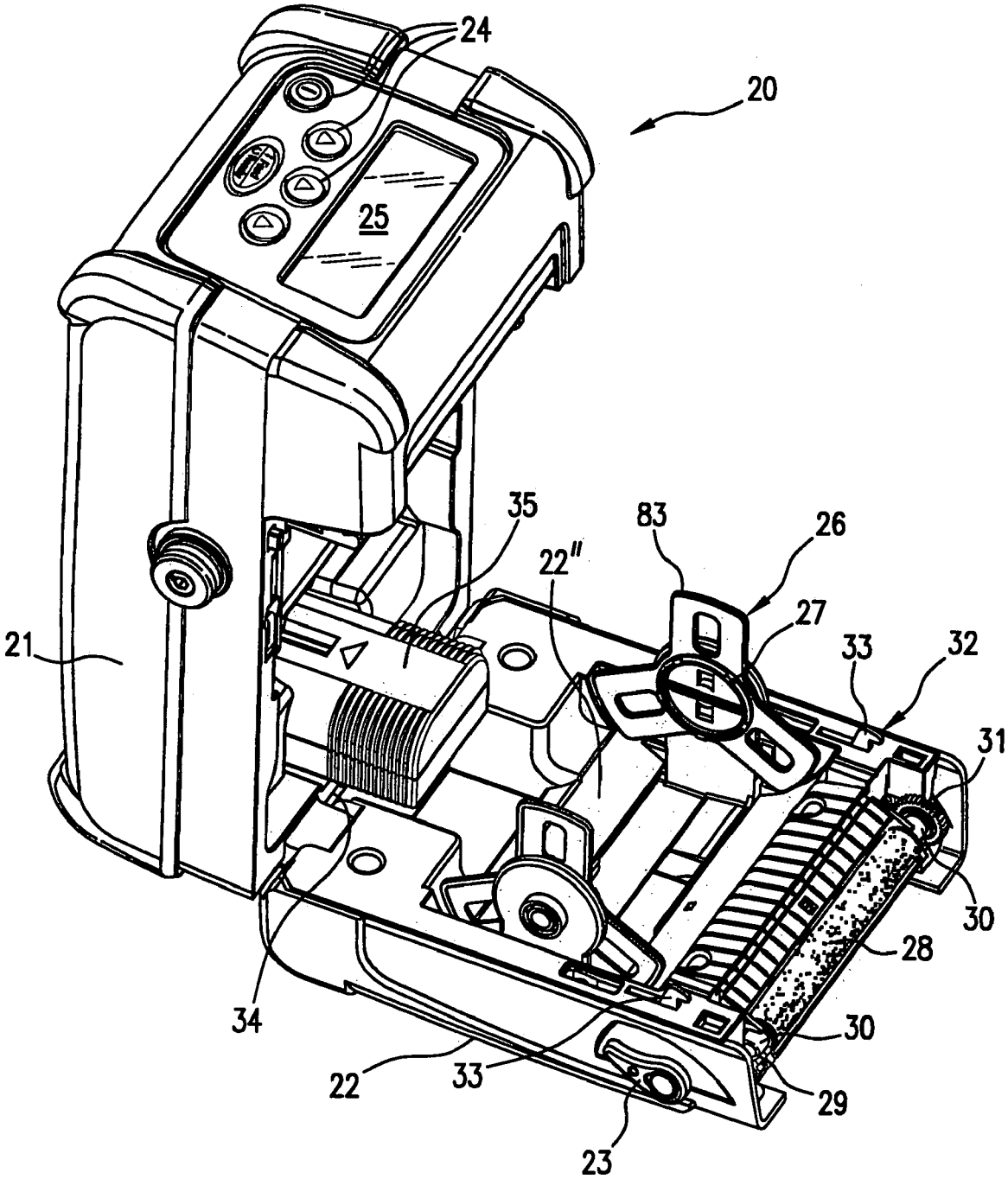
FIG. 2 is a perspective view of the printer depicted in FIG. 1, with a door or housing section in an open position.
Figure 18:
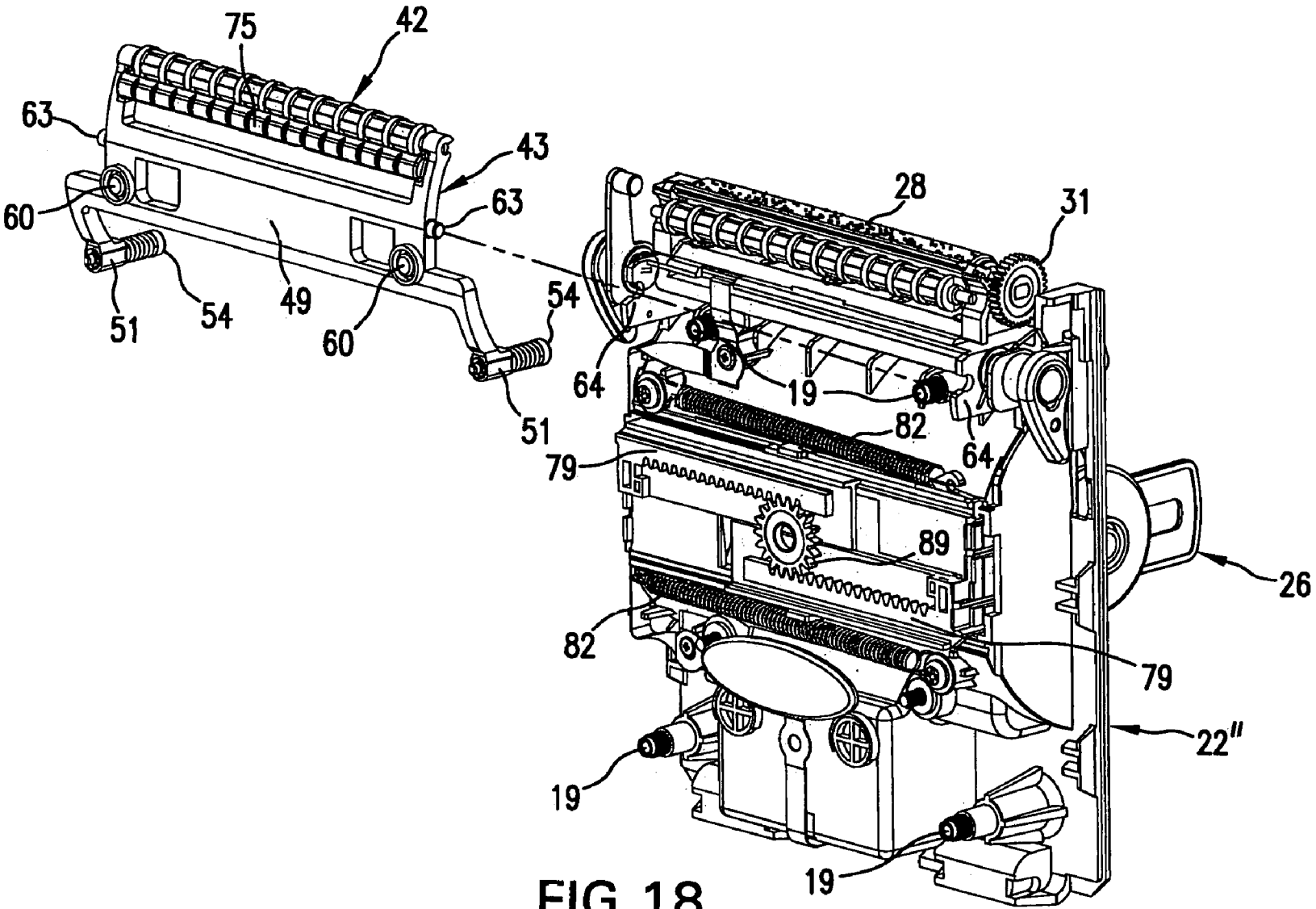
FIG. 18 is an exploded, perspective view of the door with the outer panel removed, and the platen and tear bar holder.

With reference to FIG. 1, there is shown a portable printer generally indicated at 20 having a housing 21 with a door 22 at the front of the printer 20. The door 22 has an outer panel 22' and an inner panel 22" (FIGS. 2 and 18, for example). The outer panel 22' and the inner panel 22" are connected by screws 19 (FIG. 18) secured to bosses (not shown) on the inside of the outer panel 22'. Latch handles 23 (only one of which is shown in FIG. 1) at both sides of the front door 22 are used to unlatch the front door 22 from the remainder of the housing 21. The upper portion of the housing 21 has keys 24 and a display 25. The door 22 mounts a label roll holder mechanism generally indicated at 26 with opposed annular projections 27 (only one of which is shown in FIG. 2). The annular projections 27 are received in the central opening of a label roll (not shown). A platen roll 28 mounted on a central shaft 29 on which bearings are received. A gear 31 is secured to one end portion of the shaft 29. The latch handles 23 form part of a latch generally indicated at 32 which includes latch hooks 33. The door 22 is pivotally mounted to the rest of the housing 21 by a hinge pin 34. The printer 20 is powered by a rechargeable battery 35.

Figure 3:
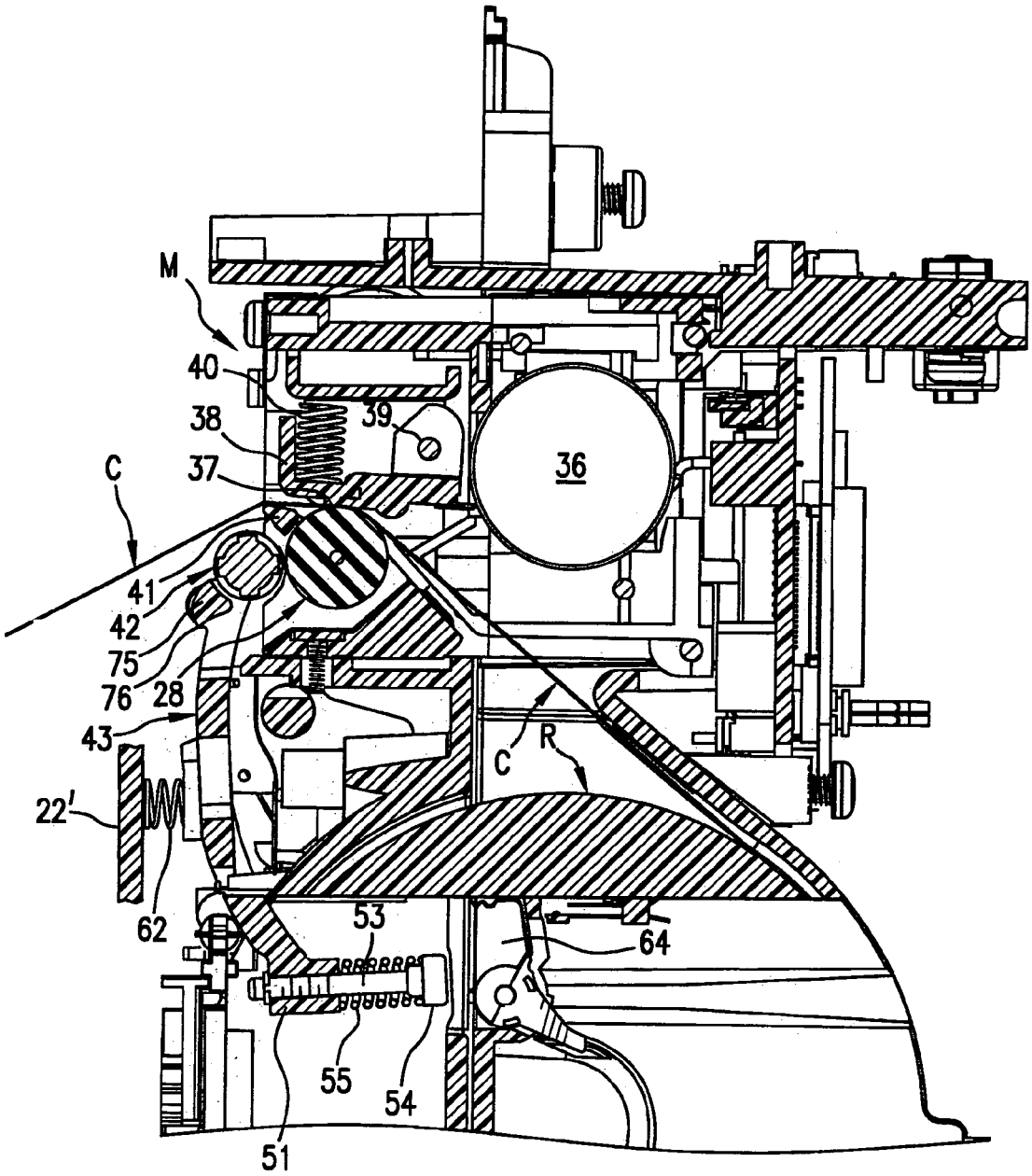
FIG. 3 is a sectional view through the printer showing the printer in the strip mode.

With reference to FIG. 3, the platen roll 28 is driven by gearing 31' (FIG. 4) which meshes with the gear 31. The gearing 31' and in turn the gear 31 are driven by an electric motor 36. A print head 37 (FIG. 3) is mounted by a holder 38 pivotable about a pin 39. A compression spring 40 urges the holder 38 and the print head 37 counterclockwise in FIG. 2 toward the platen roll 28. A roll R of a composite web C is comprised of a carrier web W to which labels L are releasably adhered. In the strip mode shown in FIG. 3, the composite web C is paid out of the roll R as the driven platen 28 rotates during label printing on the labels L. The carrier web W and the labels L pass over a delaminator 41. The delaminator 41 is shown to be a peel bar, but alternatively, the delaminator 41 can comprise a peel roller (not shown). The springs 40 urge the print head 37 against the composite web C which passes against the platen roll 28. The delaminator 41 is disposed downstream of the place where the print head 28 exerts pressure against the composite web C and the platen roll 28. In the strip mode, the delaminator 41 is ineffective to peel labels L from the web W. In the peel mode illustrated in FIG. 5, the carrier web W passes from the delaminator 41 to between a pressure roll 42 and the platen roll 28 and from there the web W exits the printer 20.

Figure 4:
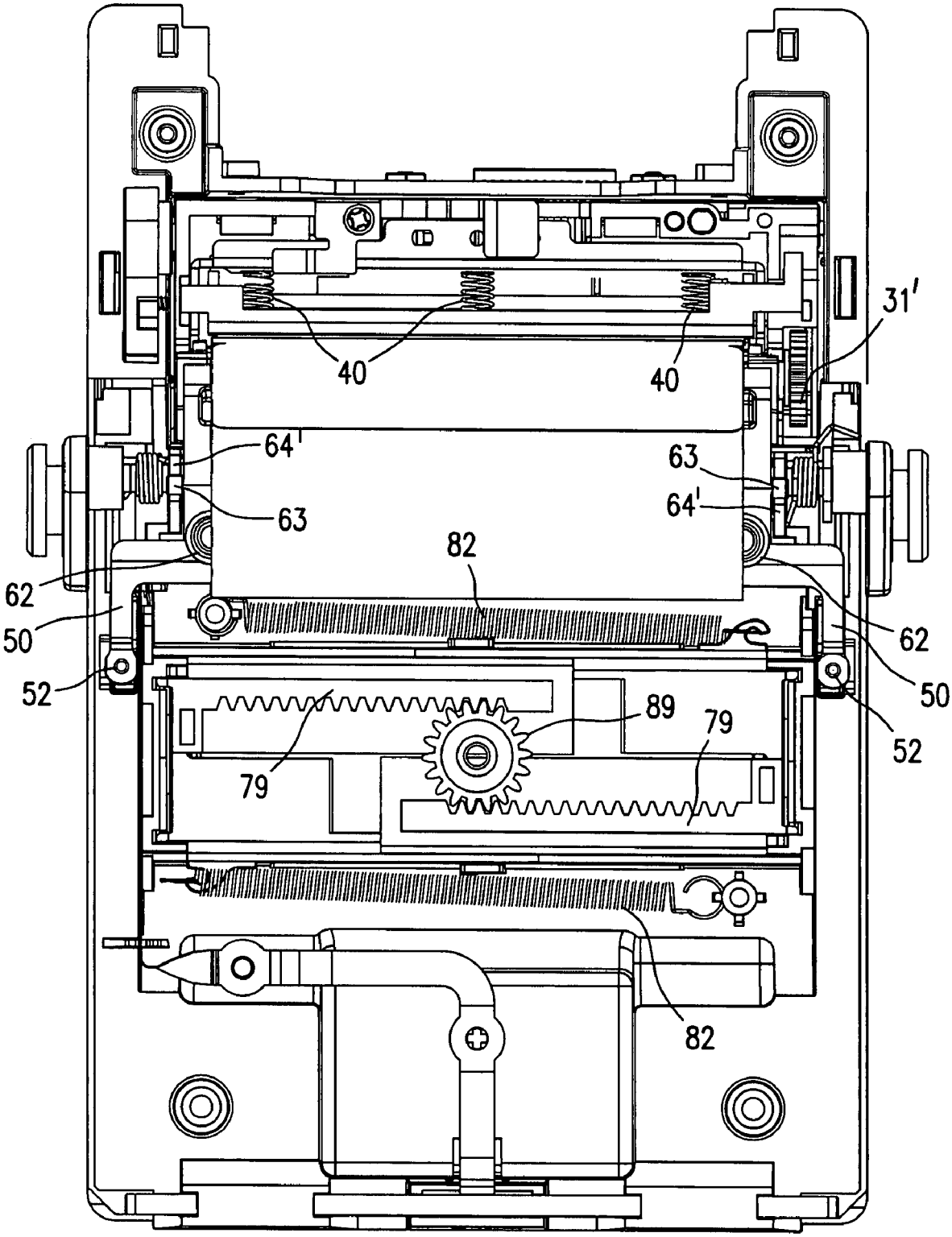
FIG. 4 is an elevational view of the printer with a housing portion removed.
Figure 5:
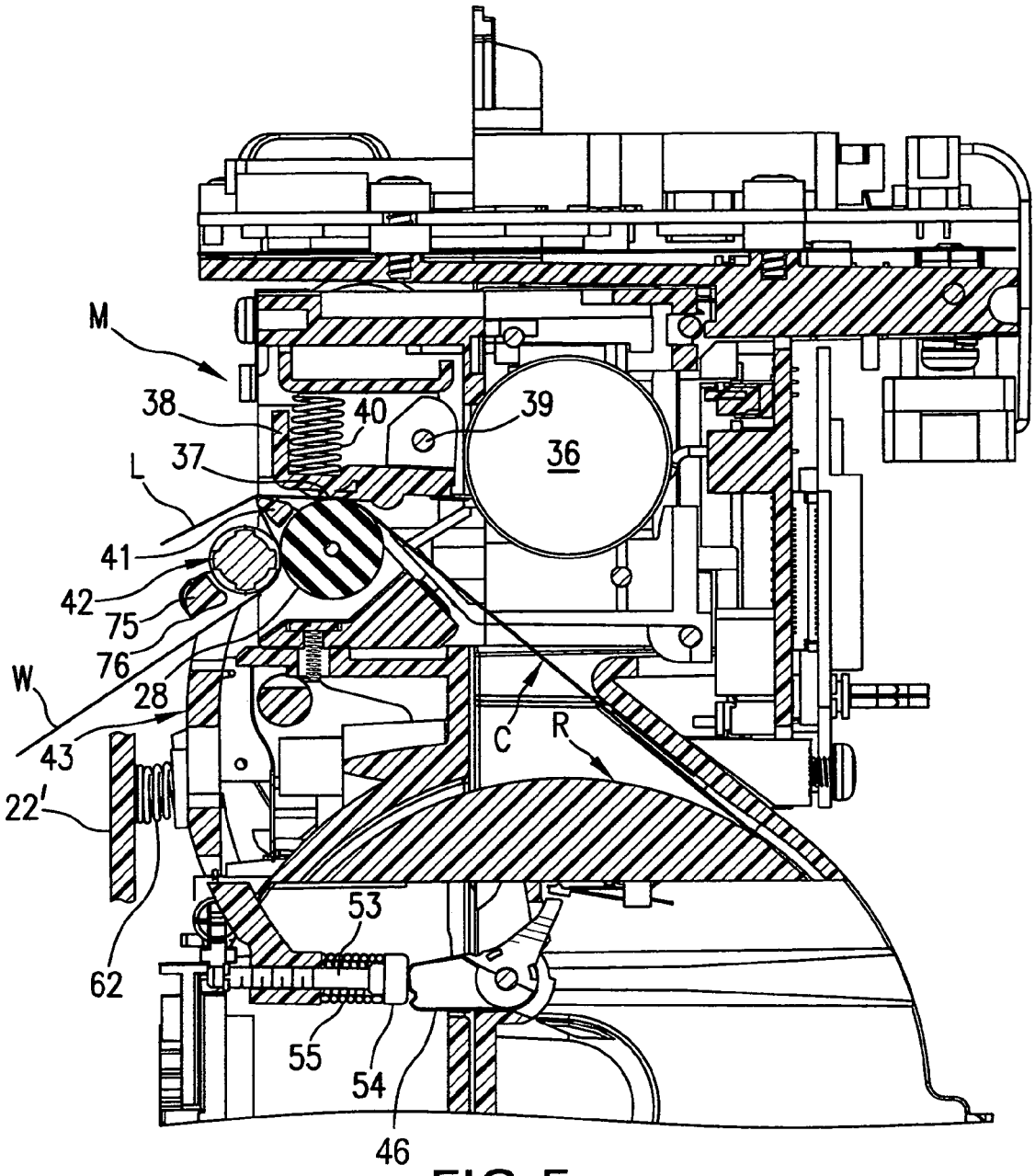
FIG. 5 is a fragmentary view similar to FIG. 3, but showing the printer in a peel mode.
Figure 6:
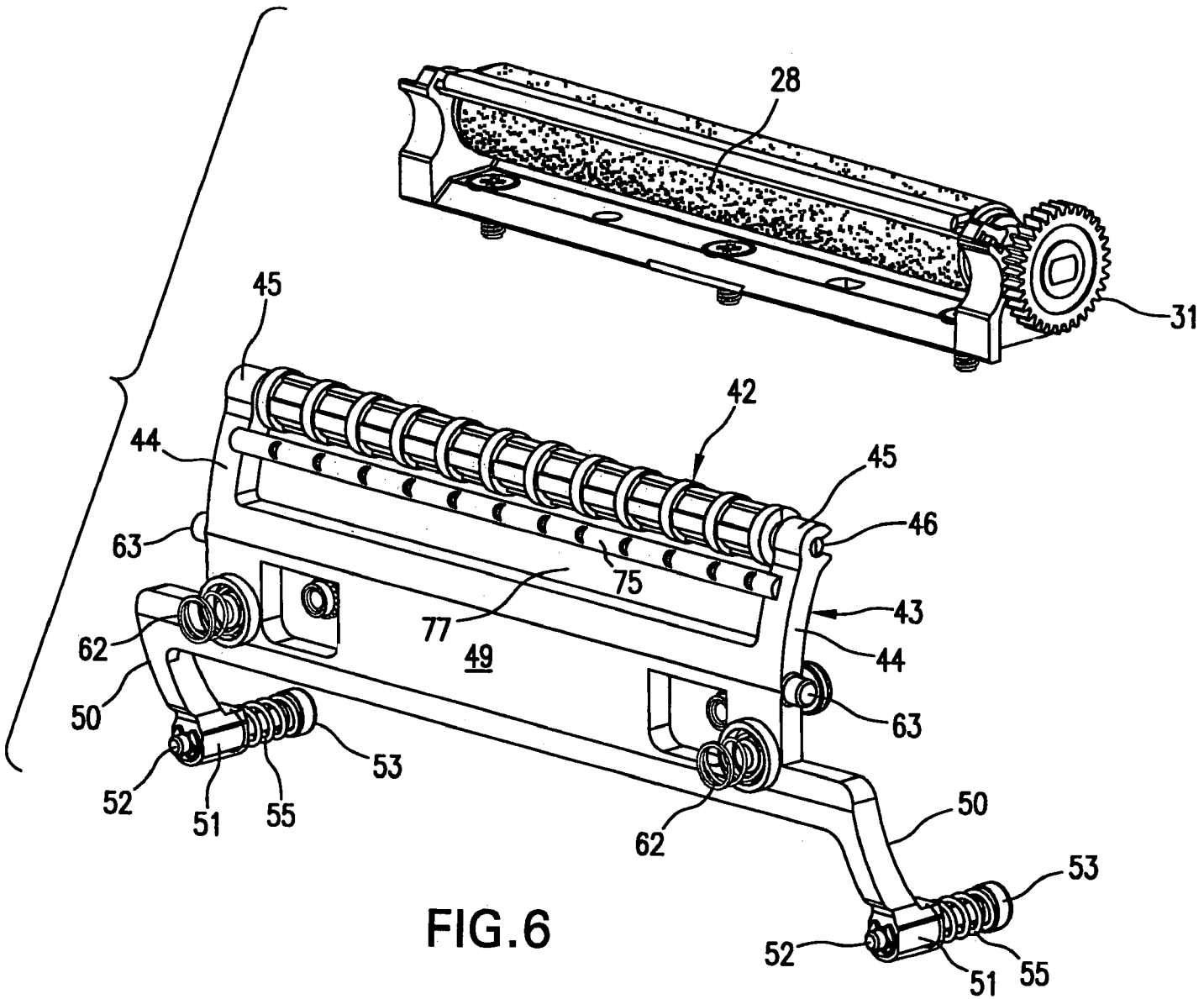
FIG. 6 is an exploded perspective view of the platen roll and its mounting structure and a pressure roll and tear bar mechanism.
Figure 7:
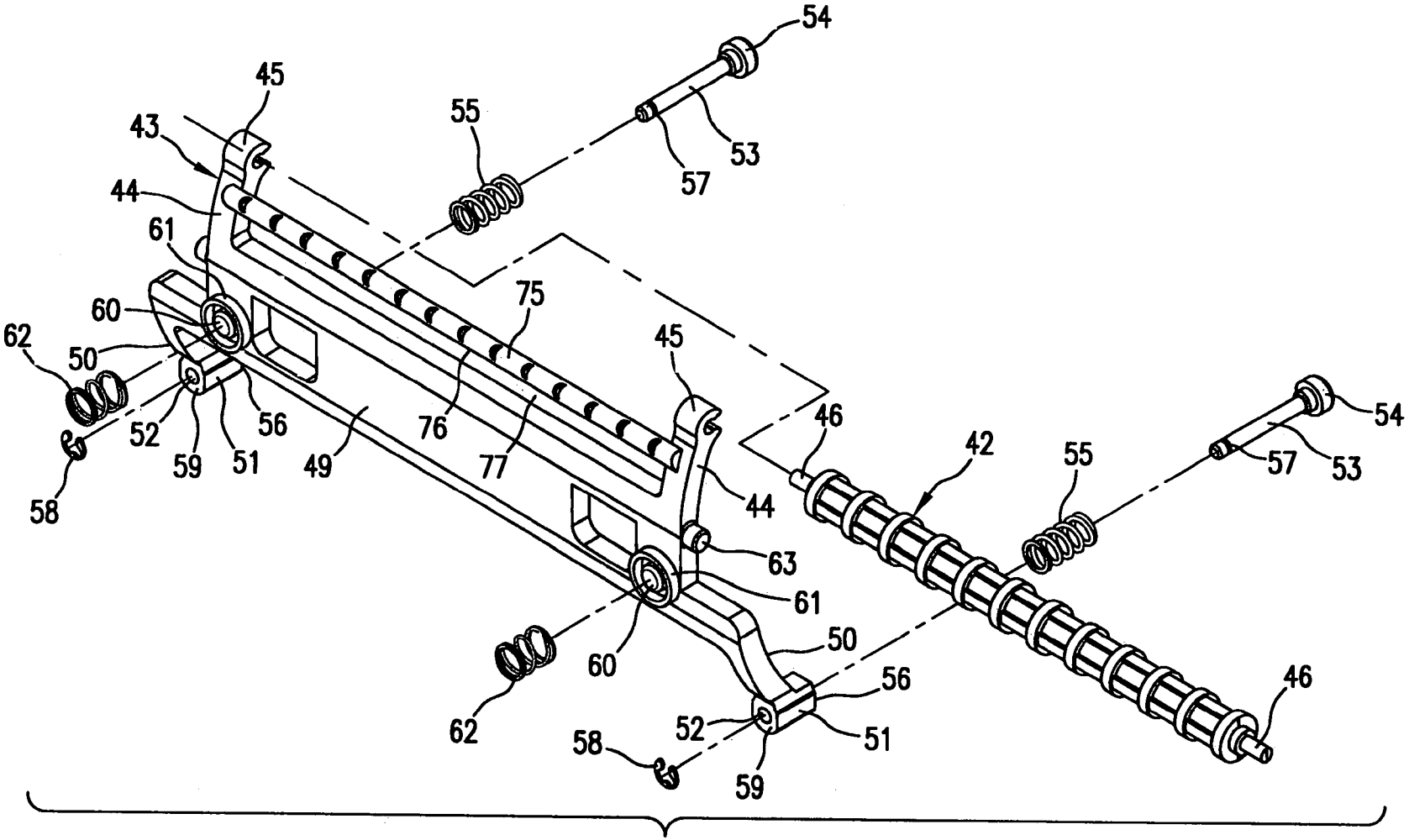
FIG. 7 is a perspective view of a label roll holding mechanism.
Figure 10:
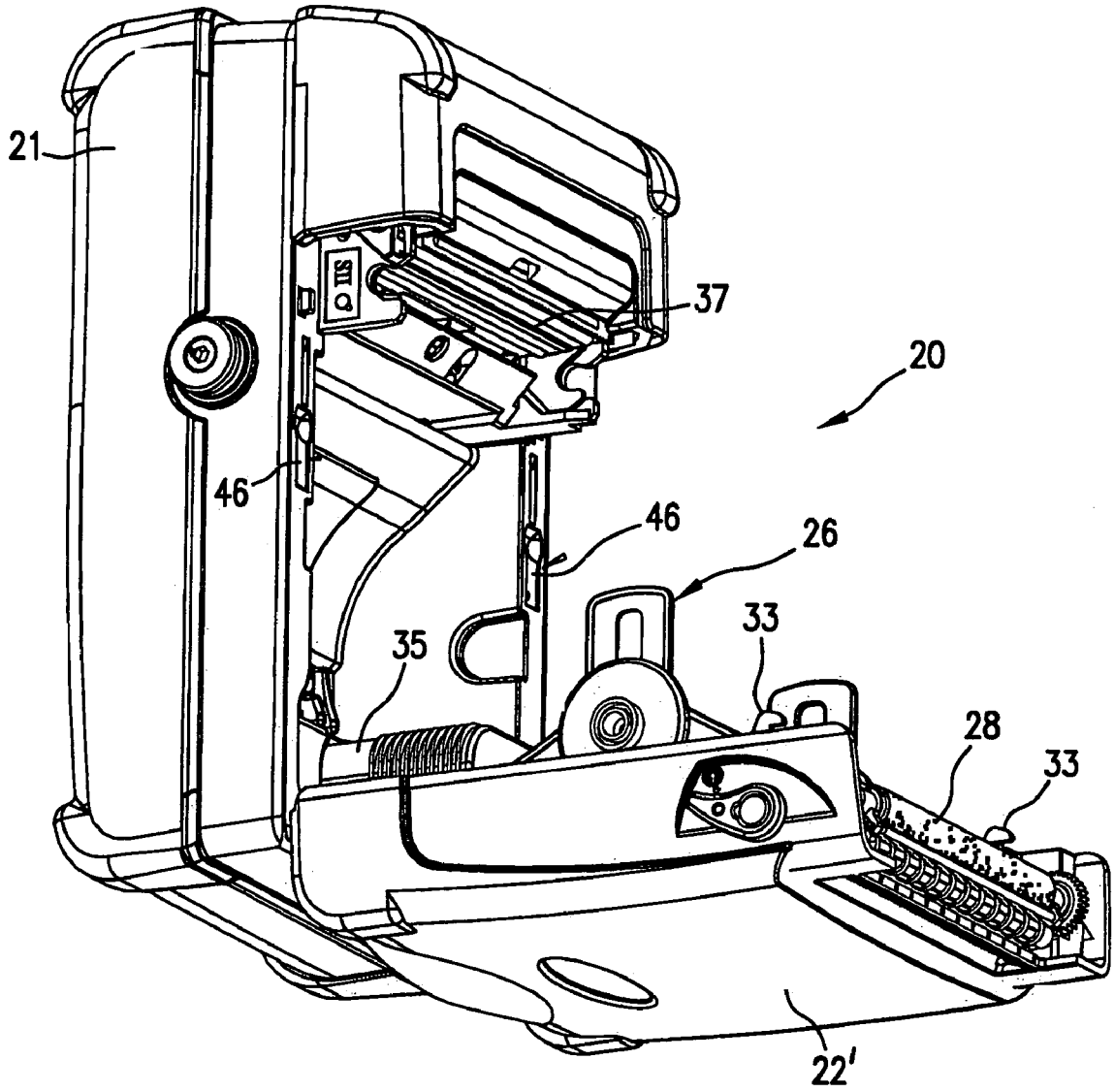
FIG. 10 is a perspective view of the printer with its door open to show the strip mode.
Figure 11:
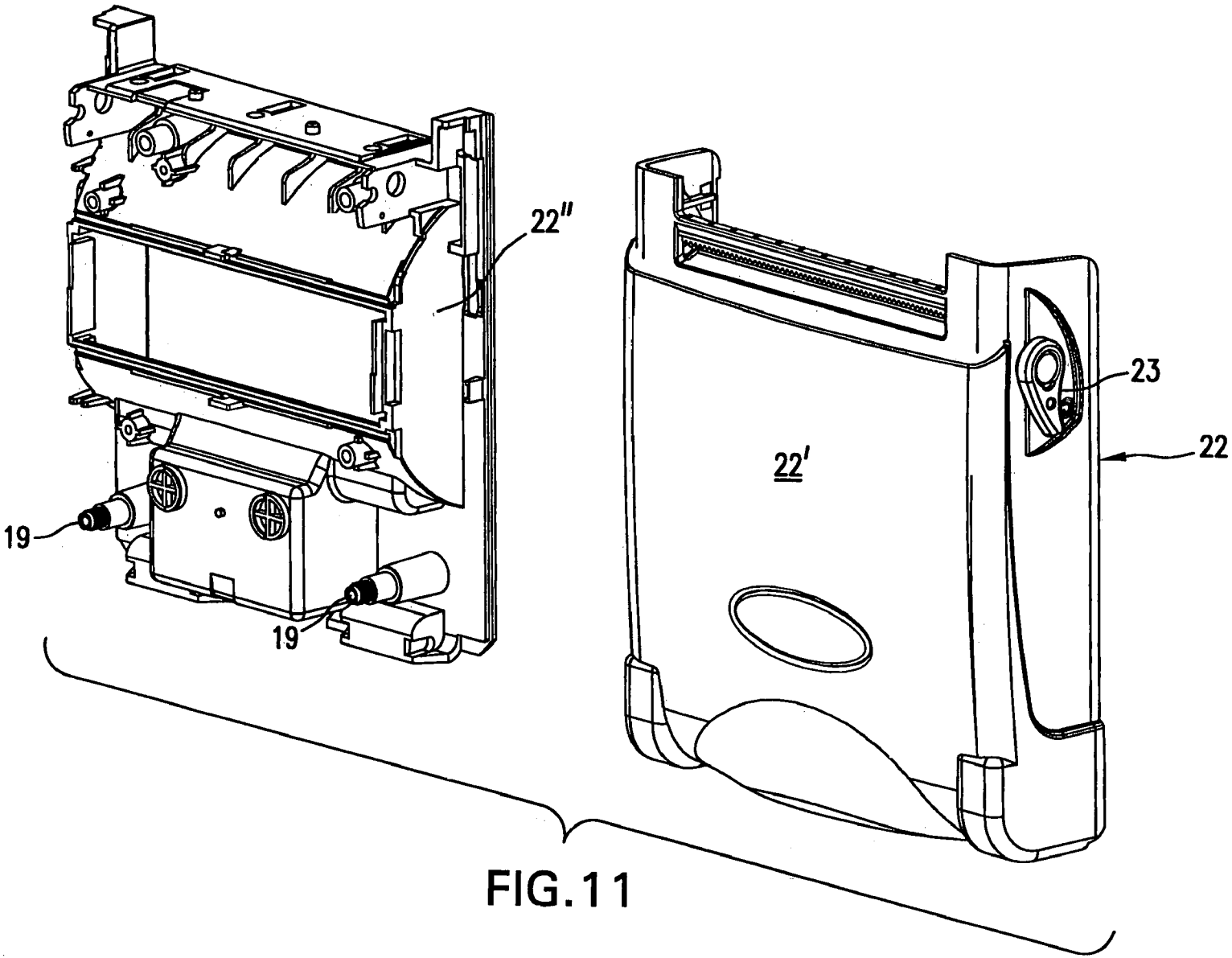
FIG. 11 is a perspective view of one of the housing sections.
Figure 12:
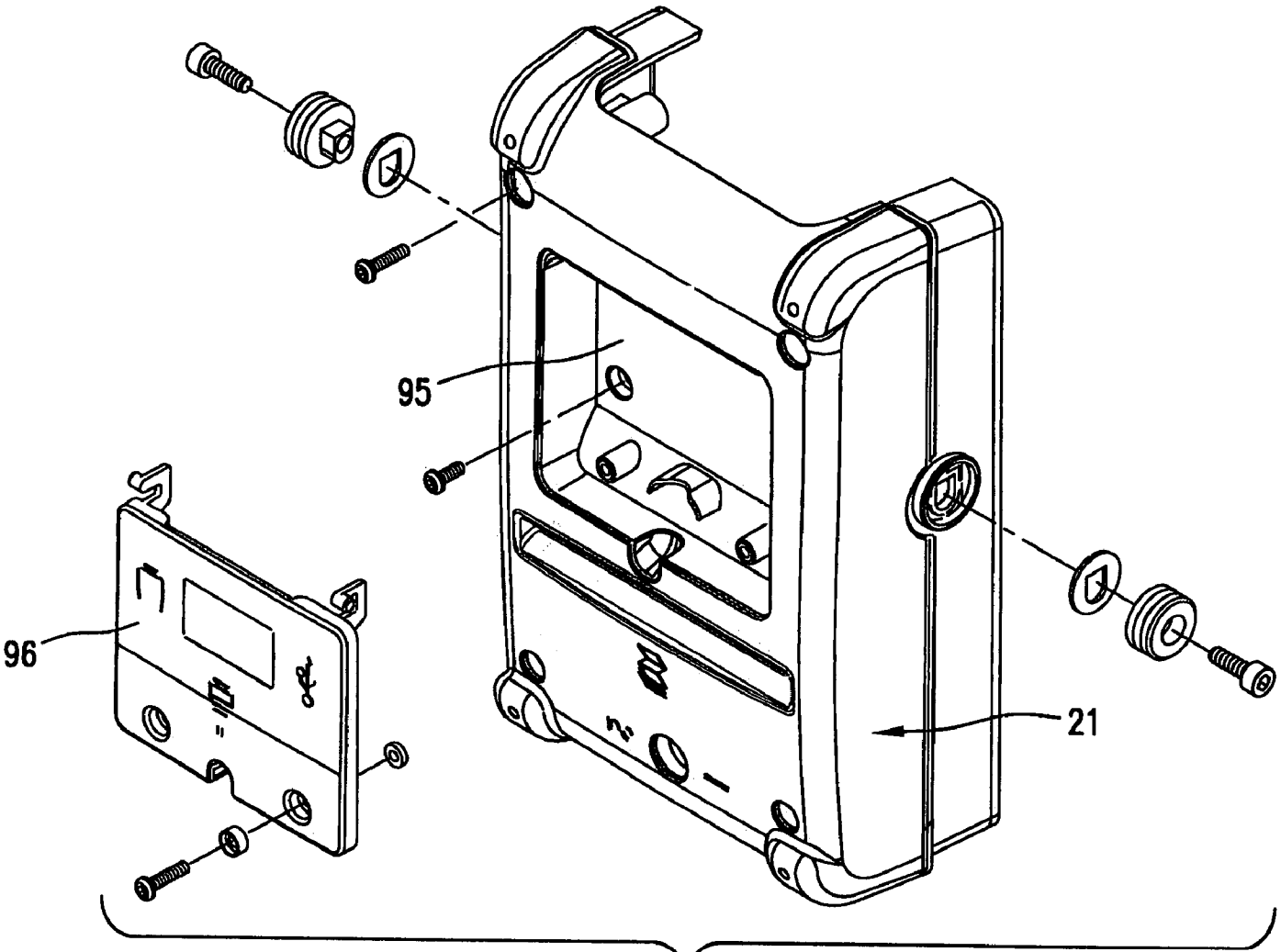
FIG. 12 is a perspective view of the door.

With reference to FIGS. 6 and 7, and initially to FIG. 6, the pressure roll 42 is shown to be mounted on a holder or carrier 43. The holder 43 has arms 44 with snap sockets 45. The pressure roll 42 is of one-piece molded plastics construction and has stub ends 46 received in the snap sockets 45. The pressure roll 42 is free to rotate in the snap sockets 45. The arms 43 also mount a tear bar 75 having a tear edge 76. The arms 44 are joined to a transverse section or member 49. Joined to the section 49 are a pair of arms 50 spaced apart more widely than arms 44. The arms 50 have guides 51 which through-holes 52 (FIG. 7). Pins 53 have heads 54. The pins 53 are slidably received in through-holes 52. Compression springs 55 received on the pins 53 bear against heads 54 and against shoulders 56 of the guides 51. The pins 53 have grooves 57 which receive E-rings 58. The springs 55 are preferably in slight compression when E-rings 58 abut shoulders 59. The section 49 has posts 60 and annular projections 61 spaced outwardly of the posts 60. Compression springs 62 are received about the posts 60 within the annular projections 61 so that the springs are located with respect to the holder 43. The holder 43 also has a pair of outwardly extending pivots or posts 63 snapped into sockets 64' (FIG. 4). It is noted that the pivots 63 are between the pressure roll 42 and the places where the springs 62 bear against the holder 43. The springs 62 bear against the housing as shown in FIGS. 3 and 5 and are normally under compression as they urge the holder 43 counterclockwise to the position shown in FIG. 3. It is noted that in this position, the heads 54 of the pins 53 are out of contact with positionable stops or actuators 64. In FIGS. 3 and 10 the stops 64 are in the ineffective positions out of contact with heads 54, and accordingly, the stops 64 have no affect on the holder 43. The springs 62, therefore, set or control the position of the pressure roll 42, namely, the pressure roll 42 is urged out of pressure contact with the platen roll 28. In the FIG. 3 position, the pressure roll 42 is out of contact with the platen roll 28. This reduces drag on the motor 36 in the strip mode depicted in FIG. 3.

Figure 9:
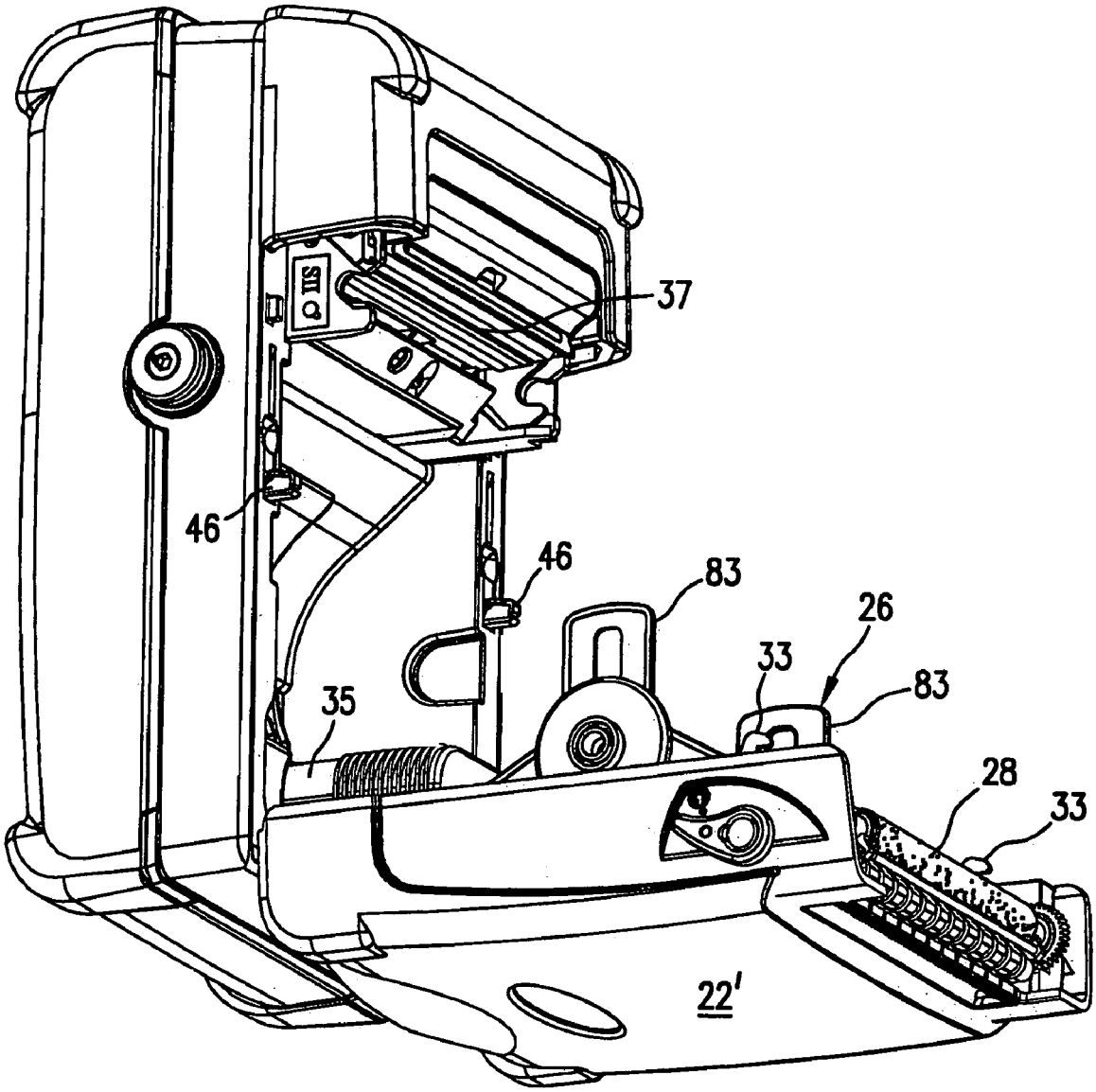
FIG. 9 is a perspective view of the printer with its door open to show the peel mode.

FIG. 5 is like FIG. 3 except that in FIG. 5 the holder 43, the pressure roll 42 and the stops 64 are in their peel mode positions. In FIG. 5, the head 54 is shown to abut the stop 64, and the spring 55 is more compressed than shown in FIG. 3. The forces of the springs 62 are overcome and the pressure roll 42 are shown in pressure cooperation with the carrier web W and the platen roll 28. In particular, the pressure roll 42 is in pressure contact with the carrier web W and the carrier web W is in pressure contact with the platen roll 28. Thus, the carrier web W is sandwiched between the pressure roll 42 and the driven platen roll 28 downstream of the delaminator 41. Accordingly, rotation of the platen roll 28 advances or moves the carrier web W so that the leading label L is peeled from the carrier web W at the delaminator 41. The carrier web W exits the printer through the space 77 between the tear bar 75 and the transverse section 49 of the holder 43. By simply repositioning the stops from their ineffective positions (FIGS. 3 and 10) to their effective positions (FIGS. 5, 9 and 14) the printer 20 can be changed from its strip mode to its peel mode, and vice versa.

Figure 14:
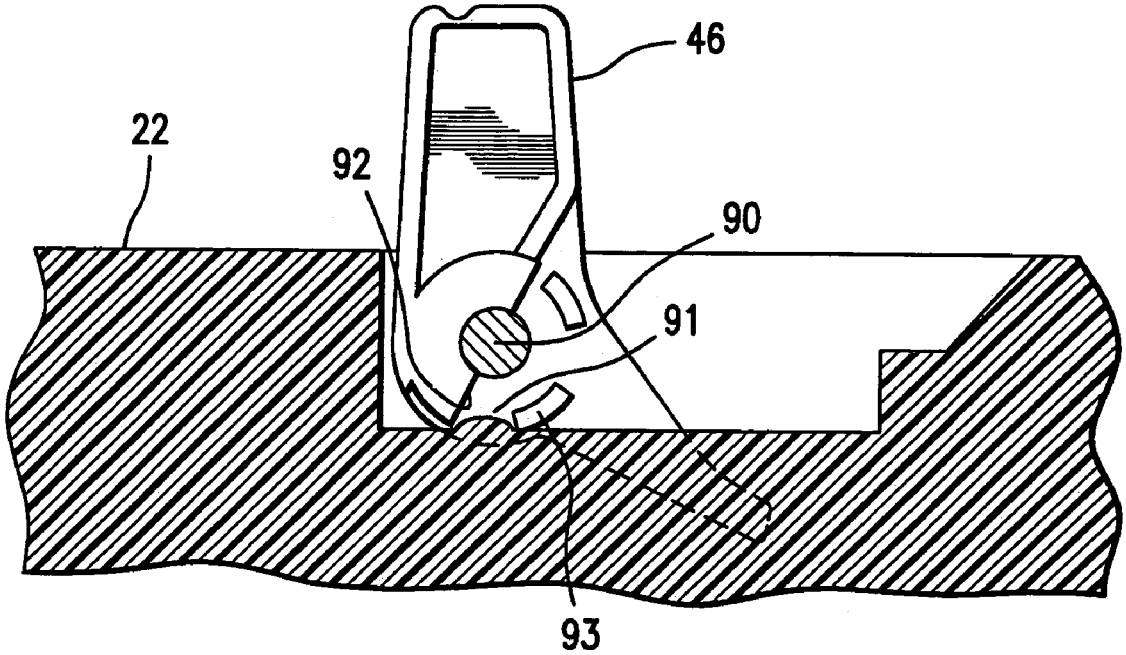
FIG. 14 is a sectional view showing a stop or actuator in a peel mode position.
Figure 15:
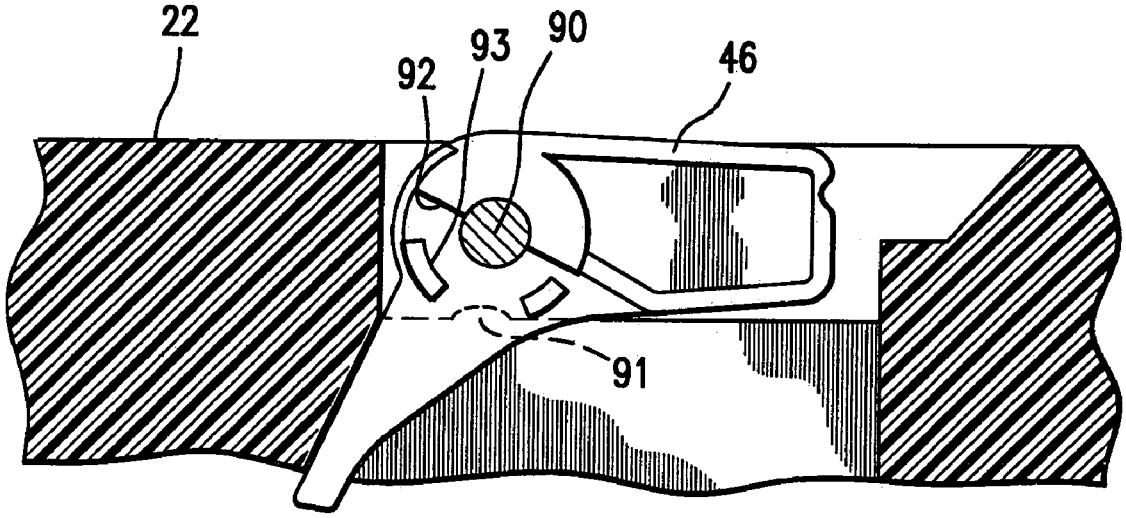
FIG. 15 is a sectional view showing the stop in a strip mode position.
Figure 16:
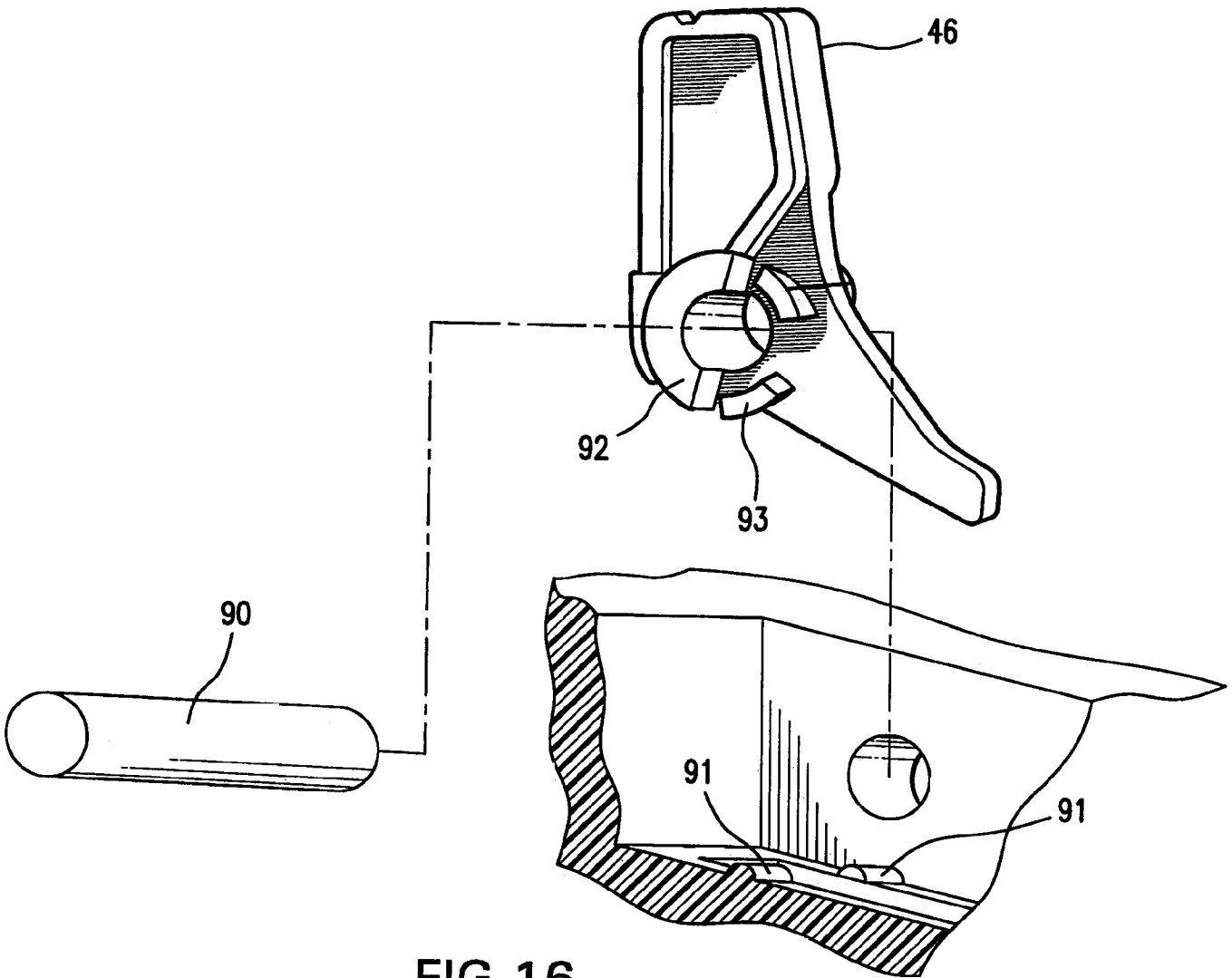
FIG. 16 is a perspective view showing the stop in its peel mode position.
Figure 17:
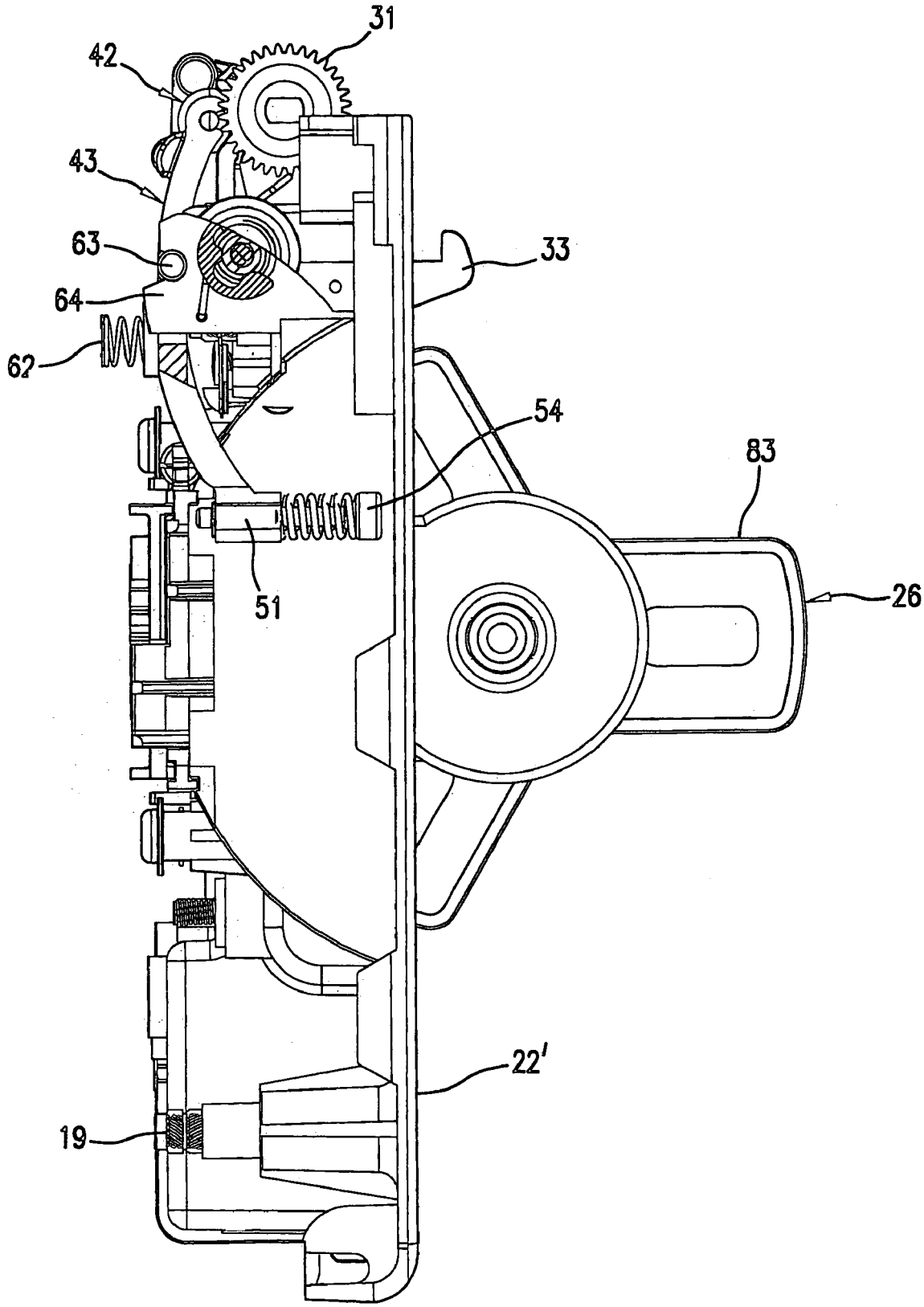
FIG. 17 is a fragmentary side elevational view of the door or housing section.

The stops 46 are identical. Each stop 46 is pivotally mounted on a pin 90 for movement between the peel mode position shown in FIGS. 9, 14 and 16 and the strip mode position shown in FIGS. 10 and 15. The housing has a pair of projections 91 that fit between pairs of abutments 92 and 93 when the stop 46 is in the peel mode position (FIG. 14 for example). Both sides of the stops 46 are the same although only one side is shown, each side having a pair of abutments 92 and 93 cooperable with a respective projection 91. In that the stops 46 and the housing 22 in which the stops 46 are pivotal are constructed of plastics material, the stops 46 can be pivoted clockwise from the FIG. 14 position to the FIG. 15 position, and there is enough yield or give between the projections 91 and the abutments 93 to enable such pivotal movement. The stops 15 can be returned from the FIG. 15 position to the FIG. 14 position by the abutments 93 and the projections 91 yielding. The projections 91 and the abutments 92 and 93, therefore, provide a detent for the stops 46.

The holder 43 and the pressure roll 42 are each of one-piece molded plastics construction.

Figure 8:
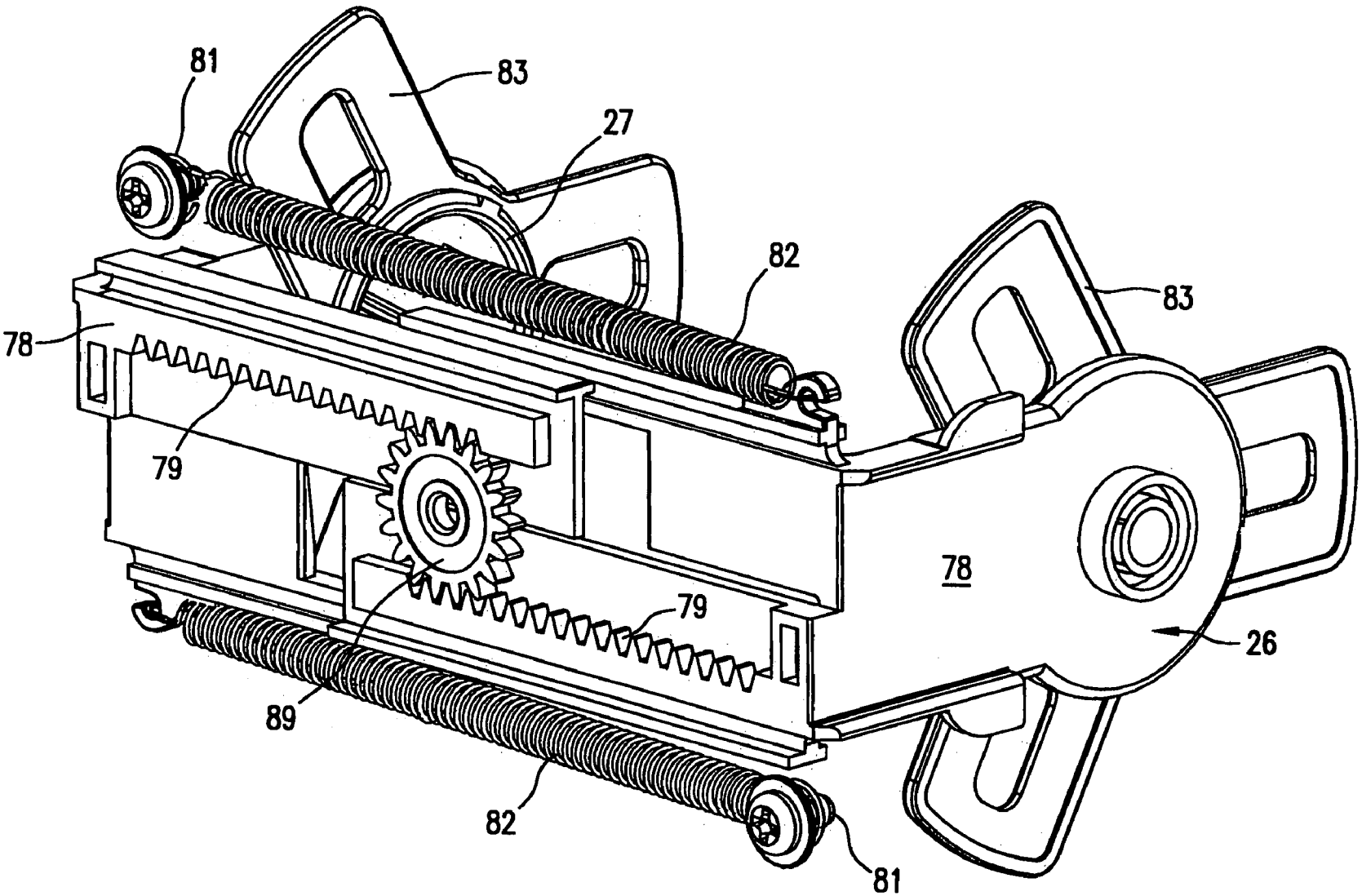
FIG. 8 is an exploded perspective view of the pressure roll and tear bar mechanism.

With reference to FIG. 8, the label roll holder 26 includes a pair of holder members 78 each having a straight gear or rack 79. A gear 80 rotatable on a stud secured to the housing is coupled to the racks 79. Screws 81 secured to the housing 21 are connected to tension springs 82. The tension springs 82 are also connected to the holder members 78 as best shown in FIG. 8. The holder members 78 mount opposed identical, roll-engaging members 83 between which a label roll R is held. The members 83 are preferably rotatable on holder members 78 to minimize the drag on the motor as the label roll unwinds upon rotation of the platen roll 28. The springs 82 pull on the holder members 78 and urge members 83 toward each other. The arrangement of the gear 89 and racks 79 causes the holder members 78 and the members 83 to move relatively toward and away from each other when manual force is applied against holder members 78 or the members 83.

The housing 21 has a compartment 95 for a radio (not shown) and a cover 96 securable to the housing 21 for closing off the compartment 95.

Figure 13:
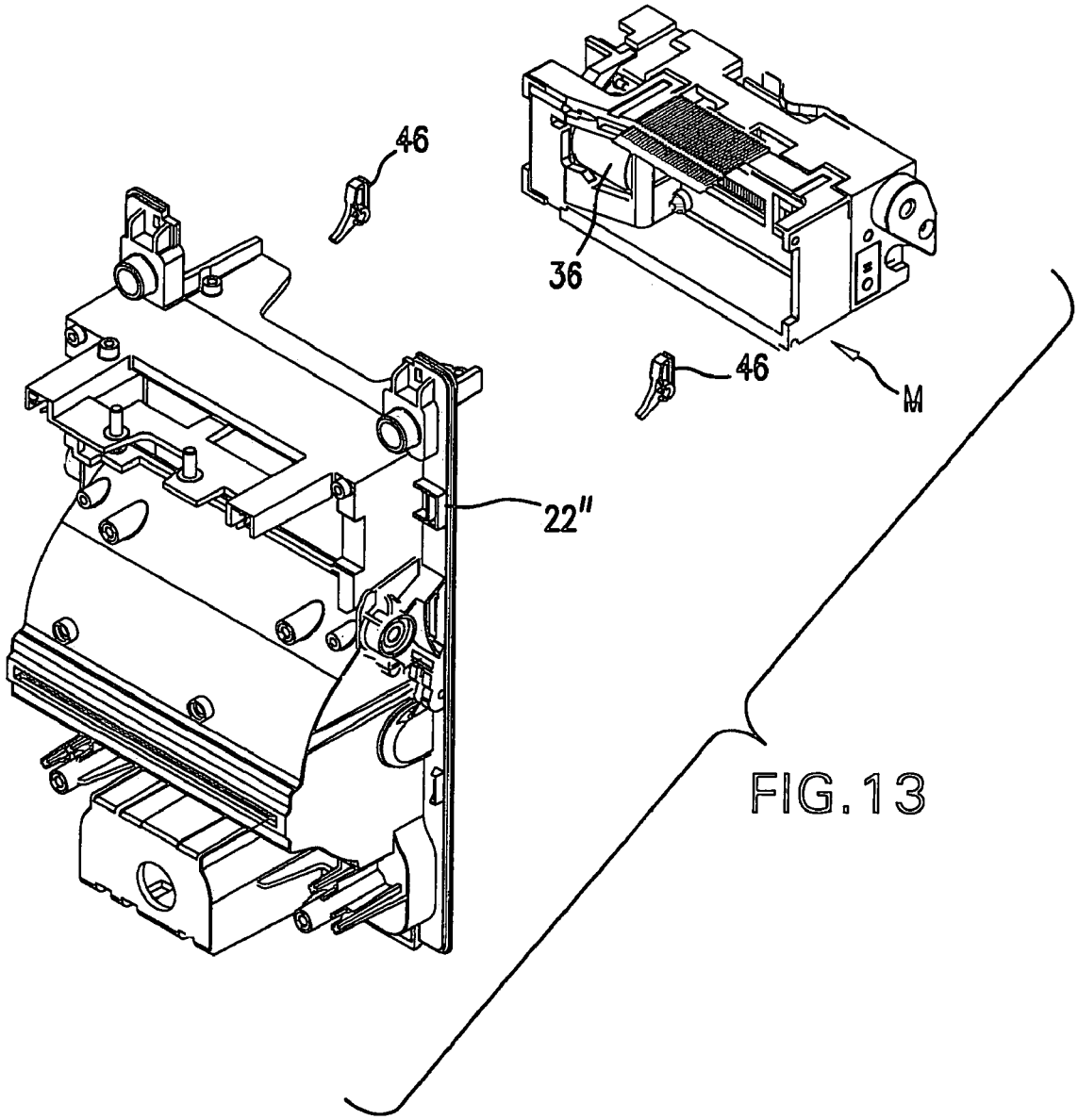
FIG. 13 is an exploded perspective view of a housing section and a print module.

The print head module M mounted in the housing 21 includes the motor 36, print head 37, holder 38, pivot 39, spring 40 and gearing 31' and is shown in assembled form in FIG. 13. The module M is a subassembly which can comprise, for example, an LTP V Series thermal printer mechanism of Seiko Instruments, Inc.

Other embodiments and modifications of the invention will suggest themselves to those skilled in the art, and all such of these as come within the spirit of this invention are included within its scope as best defined by the appended claims.

We claim:

1. A printer operable in either a strip mode wherein a printable strip is dispensed or in a peel mode wherein labels on a carrier web are peeled and dispensed from a carrier web, the printer comprising:

a print head, a driven platen roll cooperable with the print head, a delaminator disposed downstream of the print head, a pressure roll disposed downstream of the delaminator, a holder, wherein the holder mounts the pressure roll in a strip mode position out of pressure cooperation with the carrier web and the platen roll in the strip mode and a peel mode position in pressure cooperation with the carrier web and the platen roll in the peel mode, and an actuator selectively positionable out of actuating relationship with the holder in the strip mode and in actuating relationship with the holder in the peel mode, and the actuator being operative to locate the pressure roll in the peel mode position.

2. A printer as defined in claim 1, including at least one spring to urge the holder to the strip mode position.

3. A printer as defined in claim 1, including at least one spring acting on the holder to urge the pressure roll to the strip mode position, wherein the actuator includes at least one stop settable in either a first position or in a second position, the stop(s) being effective in the first position to act on the holder to overcome the force(s) of the spring(s) and to urge the pressure roll into the peel mode position and the stop(s) being ineffective in the second position to act on the holder either to overcome the force(s) of the spring(s) or to urge the pressure roll into the peel mode position.

4. A printer as defined in claim 1, including a tear bar on the holder.

5. A printer as defined in claim 1, including at least one spring that helps resiliently urge the pressure roll in pressure relationship with the platen roll in the peel mode.

6. A printer as defined in claim 1, including a housing having a first housing section and a second housing section relatively movable between open and closed positions, wherein the platen roll, the delaminator, the pressure roll, and the holder are on the first housing section and the actuator is on the second housing section.

* * * * *